US005515819A

United States Patent [19]

Groh et al.

[11] Patent Number: 5,515,819

[45] Date of Patent: May 14, 1996

[54] BIASING ASSEMBLY FOR A VARIABLE VALVE TIMING MECHANISM

[75] Inventors: David M. Groh, Battle Creek; Jon T. Barrett, Bay City; Gary L. Janowiak, Saginaw, all of Mich.

[73] Assignee: Eaton Corporation, Cleveland, Ohio

[21] Appl. No.: 334,824

[22] Filed: Nov. 4, 1994

[51] Int. Cl.[6] ..... F01L 1/34; F01L 3/10

[52] U.S. Cl. ..... 123/90.16; 123/90.44; 123/90.65

[58] Field of Search ..... 123/90.15, 90.16, 123/90.17, 90.22, 90.27, 90.39, 90.4, 90.44, 90.65

[56] References Cited

U.S. PATENT DOCUMENTS 4,787,346 11/1988 Ajiki et al. ..... 123/90.44
4,883,027 11/1989 Okawa et al. ..... 123/90.16
4,905,639 3/1990 Konno ..... 123/90.16
5,320,082 6/1994 Murata et al. ..... 123/90.16
5,367,991 11/1994 Asai et al. ..... 123/90.16

*Primary Examiner*—Weilun Lo
*Attorney, Agent, or Firm*—Frank M. Sjovec

[57] ABSTRACT

A biasing device for a free rocker arm in an engine valve actuating system wherein driven rocker arms are selectively engaged with the free rocker arm to provide variable valve operating characteristics. The biasing device includes interfitting, cold-formed cup-shaped members within which a compression spring is received in interference fit at one end with the body and at the other end with the plunger. In a preferred embodiment, at least two coils of the spring are in interference fit with the body to provide spring damping.

5 Claims, 2 Drawing Sheets

BIASING ASSEMBLY FOR A VARIABLE VALVE TIMING MECHANISM

A BIASING ASSEMBLY FOR A VARIABLE VALVE TIMING MECHANISM

The present invention relates to valve operating apparatus for an internal combustion engine and, more particularly, to a lost motion device for a variable valve timing system for an internal combustion engine.

In valve operating devices of the type described, driver cam followers, operably connected to the valve or valves to be operated, and free cam followers, independent of the valves, are disposed adjacent each other and are operable in different modes by rotation of the cams. A selective coupling carried by the cam followers is actuable for selectively interconnecting or disconnecting the respective cam followers according to the desired mode of valve operation. Lost motion devices in the form of resilient biasing means are employed for urging the free cam follower toward its associated cam.

In prior art valve operating devices of this type, the resilient biasing means comprises a single spring disposed between the free cam follower and the engine body for resiliently urging the free cam follower toward the camshaft. While such devices are relatively simple in concept, prior art devices require fairly complex manufacturing operations and tight tolerances. It is an object of the present invention to reduce the cost of the lost motion device by simplifying its construction while maintaining and in certain respects improving the functionality of the prior art device.

According to the present invention, the resilient biasing means employed in such apparatus comprises an abutment member abutting against the free cam follower and a spring arrangement disposed in series between the abutment member and the engine body. By utilizing cold formed components and relying on press fits to retain the spring and associated components, the cost of manufacturing the device is significantly reduced without compromising performance.

For a better understanding of the invention, its operating advantages and the specific objectives obtained by its use, reference should be made to the accompanying drawings and description which relate to a preferred embodiment thereof.

Figure 2:
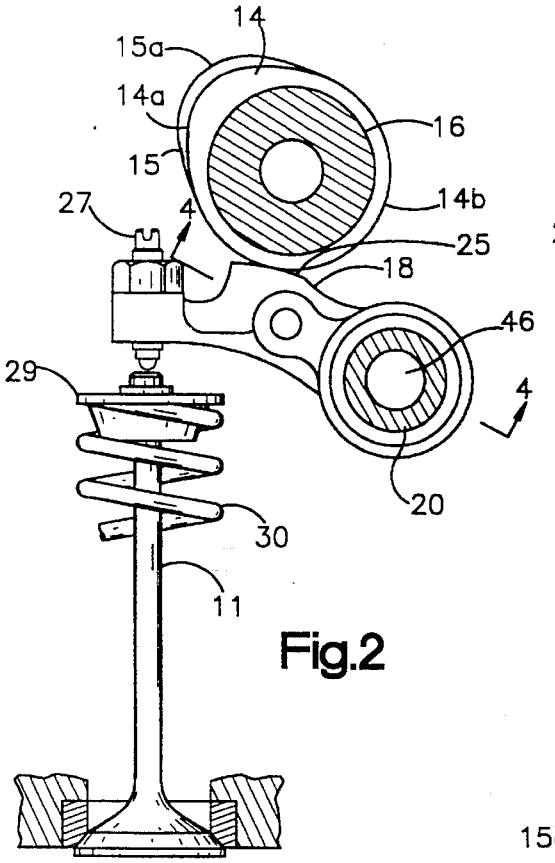
FIG. 2 is an elevational view taken in the direction of the arrow 2 in FIG. 1.
Figure 1:
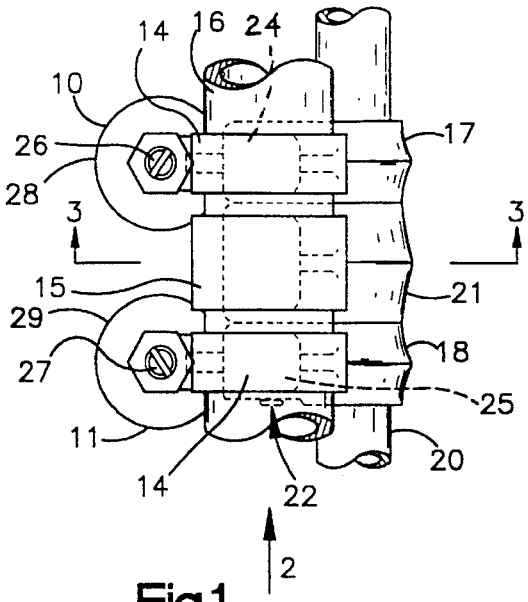
FIG.1 is a plain view of the valve operating device incorporating the present invention.

In FIGS. 1 and 2, a pair of intake valves 10, 11 disposed in the head 12 of an internal combustion engine are opened and closed by low-speed cams 14 and a high-speed cam 15 integrally formed on a camshaft 16. The camshaft 16 is rotatable in synchronism with rotation of the engine at a speed ratio of one half with respect to the speed of rotation of the engine. First and second driver rocker arms 17, 18 are angularly movably supported as driver cam followers on a rocker shaft 20 parallel to the camshaft 16, and a free rocker arm 21 is angularly movably supported as a free cam follower on the rocker shaft 20 intermediate the driver rocker arms 17, 18. A selective coupling assembly 22 is disposed between the rocker arms.

The camshaft 16 is rotatably disposed above the head 12. The lowspeed cams 14 are integrally formed on the camshaft 16 in alignment with the respective intake valves 10, 11. The high-speed cam 15 is integrally formed on the camshaft 16 in alignment with an intermediate position between the intake valves 10, 11. Each of the low-speed cams 14 has a profile corresponding to low-speed operation of the engine and includes a cam lobe 14*a* projecting radially outwardly a relatively small extent from a base circle 14*b*. The high-speed cam 15 has a profile corresponding to high-speed operation of the engine and includes a cam lobe 15*a* projecting radially outwardly from a base circle to an extent greater than that of the cam lobe 14a. The cam lobe 15*a* also has a greater angular extent than that of the cam lobe 14*a*.

The rocker shaft 20 is fixed below the camshaft 16. The first and second driver rocker arms 17, 18 and the free rocker arm 21 are pivotally supported on the rocker shaft 20 in mutually adjacent relation to each other. The first and second driver rocker arms 17, 18 are basically of the same configuration. More specifically, the first and second driver rocker arms 17, 18 have base portions swingably supported on the rocker shaft 20 in alignment with the intake valves 10, 11 and extend to positions above the respective intake valves 10*a*, 11*b*. The first driver rocker arm 17 has on its upper portion a cam slipper 24 held in sliding contact with the low-speed cam 21, and the second driver rocker arm 18 has on its upper portion a cam slipper 25 held in sliding contact with the low-speed cam 14. Tappet screws 26, 27 are threaded through the ends of the first and second driver rocker arms 17, 18 positioned above the respective intake valves 10, 11 and are engageable respectively with the upper ends of the intake valves 10, 11.

Flanges 28, 29 are attached to the upper ends of the respective intake valves 10, 11. The intake valves 10, 11 are normally urged in a closing direction, ie., upwardly, by valve springs 20 disposed between the flanges 28, 29 and the head 12.

Figure 3:
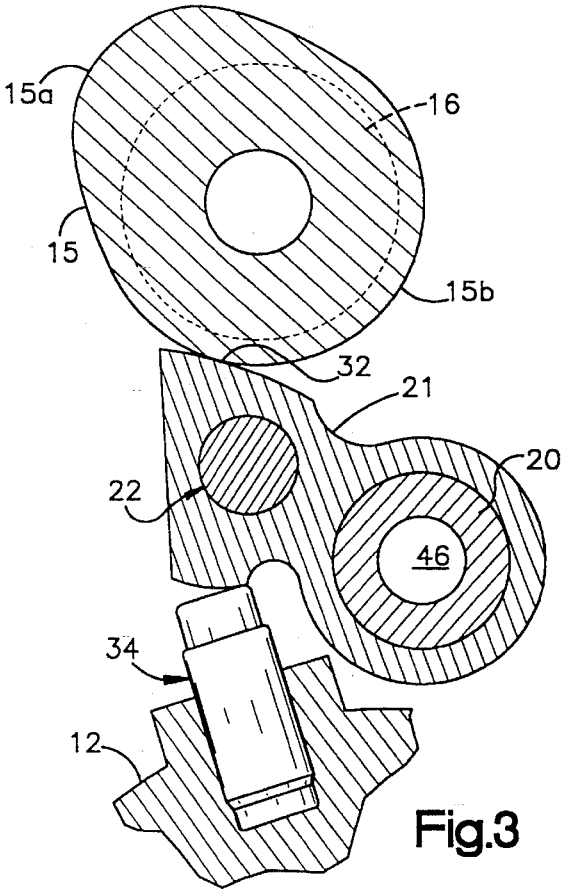
FIG. 3 is an enlarged sectional view taken along line 3—3 of FIG. 1.

As best shown in FIG. 3, the free rocker arm 21 is pivotally supported on the rocker shaft 20 between the first and second driver rocker arms 17, 18. The free rocker arm 21 extends slightly from the rocker shaft 20 toward the intake valves 10, 11 and has on its upper portion a cam slipper 32 held in sliding contact with the high-speed cam 15. A resilient biasing assembly or lost motion device 34 is received in a bore formed in the head 12 and biases the free rocker arm 21 into engagement with the high-speed cam 15, as will be described in greater detail below.

Figure 4:
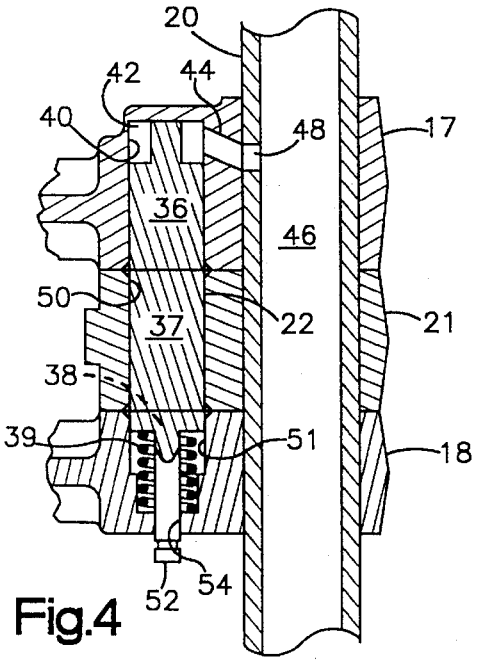
FIG. 4 is an enlarged sectional view taken along line 4—4 of FIG. 2.

As illustrated in FIG. 4, the first driver rocker arm 17 and the free rocker arm 21 are held in sliding contact with each other, and the free rocker arm 21 and the second driver rocker arm 18 are held in sliding contact with each other. The selective coupling 22 is operatively disposed between the rocker arms 17, 18, 21. The selective coupling 22 comprises a first coupling pin 36 capable of interconnecting the first driver rocker arm 17 and the free rocker arm 21, a second coupling pin 37 capable of interconnecting the free rocker arm 21 and the second driver rocker arm 18 and held coaxially against the first coupling pin 36, a stopper 38 for limiting movement of the coupling pins 36, 37, and a return spring 39 for urging the coupling, pins 36, 37 and the stopper 38 in a direction to disconnect the rocker arms. The first driver rocker arm 17 has a first guide hole 40 defined therein parallel to the rocker shaft 20 and opening toward the free rocker arm 21. The first coupling pin 36 is slidably fitted in the first guide hole 40. A hydraulic pressure chamber 42 is defined between the closed end of the first guide hole 40 and the first coupling pin 36. The first driver rocker arm 17 has a hydraulic passage 44 defined therein in communication with the hydraulic pressure chamber 42. The rocker shaft 20 has a hydraulic passage 46 coupled to a source of hydraulic pressure (not shown). The hydraulic passages 44, 46 are held in communication with each other through a hole 48 defined in a side wall of the rocker shaft 20, irrespective of the extent to which the first driver rocker arm 17 is angularly moved about the rocker shaft 20.

The free rocker arm 21 has a guide hole 50 extending between its opposite surfaces for registration with the first guide hole 40. The second coupling pin 32, having a length equal to the entire length of the guide hole 50, is slidably fitted therein. The second coupling pin 37 has an outside diameter equal to the outside diameter of the first coupling pin 36.

The second driver rocker arm 18 has a second guide hole 51 defined therein for registration with the guide hole 50. The second guide hole 51 opens toward the free rocker arm 21 and extends parallel to the rocker shaft 20. The circular stopper 38 is slidably fitted in the second guide hole 51 and held against the second coupling pin 37. A shaft 52 is coaxially joined to the stopper 38 and extends through a guide hole 54 defined in the second driver rocker arm 18 at the closed end of the second guide hole 51. The return spring 39 is disposed around the shaft 52 between the stopper 38 and the closed end of the second guide hole 51. The stopper 38, the second coupling pin 37 and the first coupling pin 36 are thereby urged by the return spring 39 into the position in which the rocker arms are mutually disconnected.

Operation of the described apparatus is as follows: During low-speed operation of the engine, no hydraulic pressure is supplied to the hydraulic pressure chamber 42. Therefore, the first and second coupling pins 36, 37 and the stopper 38 are moved a maximum stroke toward the hydraulic pressure chamber 42 by the return spring 39, In this condition, the abutting surfaces of the first and second coupling pins 36, 37 are positioned in alignment with the slidingly contacting lateral surfaces of the first driver rocker arm 17 and the free rocker arm 21, and the abutting surfaces of the second coupling pin 37 and the stopper 38 are positioned in alignment with the slidingly contacting surfaces of the free rocker arm 21 and the second driver rocker arm 18, Therefore, the first driver rocker arm 17, the free rocker arm 21 and the second driver rocker arm 18 are held in mutually sliding contact, and the first and second coupling pins 36, 37, and the second coupling pin 37 and the stopper 38 are also held in mutually sliding contact. In this condition, the rocker arms 17, 18, 21, can be angularly displaced with respect to each other.

With the rocker arms 17, 18, 21 being thus disconnected by the selective coupling 22, the first and second driver rocker arms 17, 18 are angularly moved in sliding contact with the low-speed cams 14 in response to rotation of the camshaft 16, and the intake valves 10, 11 are opened and closed at the timing and lift according to the profile of the low-speed cams 14. At this time, the free rocker arm 21 is angularly moved in sliding contact with the high-speed cam 15, but such angular movement does not affect operation of the intake valves 10, 11 in any way.

When the engine is to operate in a high-speed range, working oil pressure is supplied to the hydraulic pressure chamber 42. The first coupling pin 36 is moved axially and pushes the second coupling pin 32 and the stopper 38 against the spring force of the return spring 39. Such movement is effected when the first and second driver rocker arms 17, 18 slidingly contact the base circles 14b of the low-speed cams 14, and the free rocker arm 21 slidingly contacts the base circle 15b of the high-speed cam 15, so that the first guide hole 40, the guide hole 50 and the second guide hole 51 are axially aligned. The first coupling pin 36 is thereby caused to extend into the guide hole 50, and the second coupling pin 37 is caused to extend into the second guide hole 51.

With the first coupling pin 36 displaced into the guide hole 50 and the second coupling pin 37 displaced into the second guide hole 51, the first driver rocker arm 17, the free rocker arm 21 and the second driver rocker arm 18 are interconnected. Therefore, since the amount of angular movement of the free rocker arm 21 in sliding contact with the high-speed cam 15 is greatest, the first and second driver rocker arms 17, 18 are caused to swing with the free rocker arm 21 and, hence, the intake valves 10, 11 are opened and closed at the timing and lift according to the cam profile of the high-speed cam 15.

Figure 5:
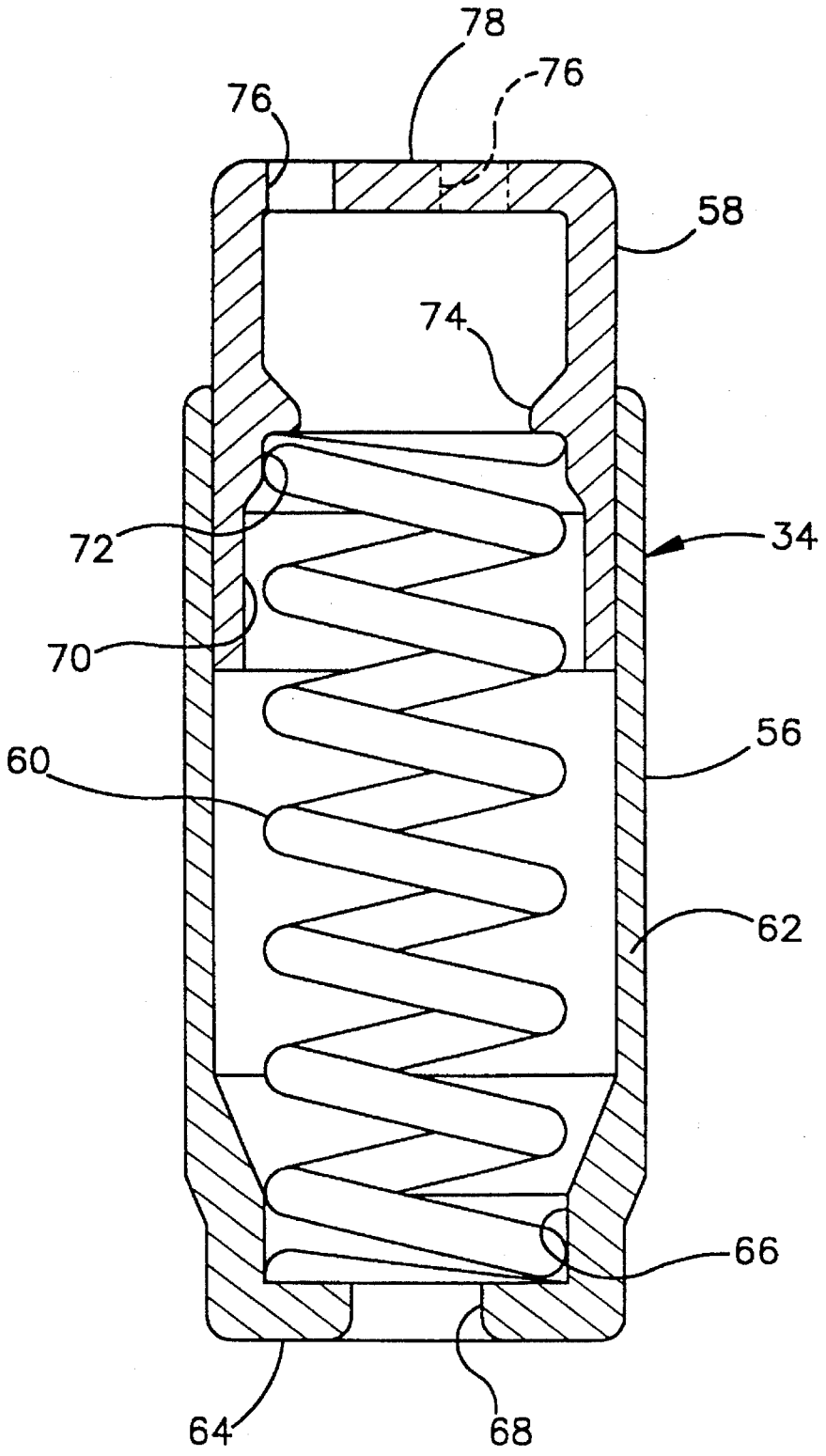
FIG. 5 is an enlarged sectional view of the present invention.

Referring to FIG. 5, the present invention provides a biasing assembly or lost motion device 34 which is reliable in operation but which is significantly simpler in construction than prior units. The assembly comprises a first cylindrical member or body 56 slidingly received in a bore formed in the head 12, a second cylindrical member or plunger 58 slidingly received within the first cylindrical member, and a compression spring 60 acting between the first and second cylindrical members to bias the second cylindrical member outward into engagement with the free rocker arm 21 to maintain the free rocker arm in engagement with the high-speed cam when the free rocker arm 21 is not interconnected with the drives rocker arms.

The first cylindrical member is preferably formed by means of a cold forming process and is in the form of an elongated cup having a relatively thin wall 62 and a heavier closed end region 64. An area of reduced internal diameter 66 provides a pocket for the spring 60. A hole 68 is formed in the bottom of the cup to permit air to vent out of the assembly when the unit is inserted in the head 12.

The plunger 58 is also a cup-shaped member formed by a cold forming process. The inside of the cup is formed with a first diameter 70, a second smaller diameter 72 within which one end of the spring is received, and an inwardly directed shelf-like projection 74 which acts as a backstop for the spring. A plurality of holes 76 is formed in the end of the plunger to vent air and lubricating oil from the unit during operation. The holes 76 are preferably formed in a pattern which leaves a flat central surface 78 on the end of the plunger for contact with the rocker arm 21.

The diameters 66 and 72 are sized such that the spring 60 is a light press fit within the two diameters to hold the two cylindrical members together prior to installation within an engine. Since more than one coil of the spring is press fit into the diameter 66, the press fit has a damping effect on the spring to minimize undue bouncing of the assembly during operation.

We claim:

1. Operating apparatus for a valve of an internal combustion engine including a camshaft rotatably driven by said engine, a first transmitting member operably engaging a first cam on said camshaft; a second transmitting member operably engaging a second cam on said camshaft; a coupling device for selectively interconnecting and disconnecting said first and second transmitting members for movement in unison and independent movement relative to each other respectively; said second transmitting member being adapted for idling movement when said coupling device is in its disconnecting mode; and means for biasing said second transmitting member against said second cam including a stationary body member; a plunger member received within said body member and engageable with said second transmitting member; and spring means received within said body member and said plunger member and operable to bias said plunger against said second transmitting member; characterized by said body member comprising a generally cup-shaped member having a thin wall section, a relatively thicker base section defining the closed end of the cup and an adjacent wall section, and a first region of reduced inside diameter formed in said adjacent wall section; said plunger member comprising an inverted generally cup-shaped member in sliding engagement with said body member, said plunger member having a second region of reduced inside diameter formed in the wall thereof; and said spring means comprising a compression spring having one end in interference fit with said first region of reduced inside diameter and the other end in interference fit with said second region of reduced inside diameter.

2. Apparatus as claimed in claim 1 in which at least two coils of said compression spring are in interference fit with said first region of reduced inside diameter.

3. Apparatus as claimed in claim I in which said plunger member is formed with a relatively thin wall section adjacent the open end thereof, said second region of reduced inside diameter defining a relatively thicker wall section adjacent said thin wall section, and an inwardly projecting lip formed adjacent said second region of reduced inside diameter, said inwardly projecting lip defining a stop for the end of said spring.

4. Apparatus as claimed in any of claims 1, 2 or 3, in which said body member and said plunger member are fabricated of cold formed steel.

5. Apparatus as claimed in claim 4 in which a plurality of holes are formed in the closed end of said plunger member, said holes being formed in a pattern which defines a substantially flat uninterrupted contact surface in the central region of said closed end.

* * * * *